US006044619A

United States Patent [19]

Kayser et al.

[11] Patent Number: 6,044,619

[45] Date of Patent: Apr. 4, 2000

[54] REEL SLITTING DEVICE AND METHOD

[75] Inventors: Franz Kayser, Geldern; Lothar Zimmermann, Krefeld, both of Germany

[73] Assignee: Voith Sulzer Finishing GmbH, Krefeld, Germany

[21] Appl. No.: 09/064,099

[22] Filed: Apr. 22, 1998

[30] Foreign Application Priority Data

Apr. 24, 1997 [DE] Germany ..... 197 17 249

[51] Int. Cl.[7] ..... B65B 63/04; B65B 11/04

[52] U.S. Cl. ..... 53/399; 53/430; 53/435; 53/118; 53/520; 53/587; 53/591

[58] Field of Search ..... 53/591, 430, 435, 53/399, 118, 520, 587, 211, 214, 215, 202

[56] References Cited

U.S. PATENT DOCUMENTS

| | | | |
|---|---|---|---|
| 3,052,073 | 6/1962 | Johansen et al. | 53/118 |
| 3,237,369 | 3/1966 | Stroop | 53/202 |
| 3,494,095 | 2/1970 | Valvano | 53/587 X |
| 4,173,108 | 11/1979 | Eglinton et al. | 53/587 |
| 5,513,478 | 5/1996 | Abt | 53/118 |
| 5,531,061 | 7/1996 | Peterson | 53/588 X |
| 5,632,456 | 5/1997 | Krüger . | |

FOREIGN PATENT DOCUMENTS

| | | |
|---|---|---|
| 0736474 | 10/1996 | European Pat. Off. . |
| 251396 | 4/1962 | Germany . |
| 2002725 | 7/1971 | Germany . |

OTHER PUBLICATIONS

Copy of Voith Sulzer Paper Technology, "DuoRoller II—The Winding Concept for Graphic Papers," (Jun. 1996).

*Primary Examiner*—Linda Johnson
*Attorney, Agent, or Firm*—Greenblum & Bernstein, P.L.C.

[57] ABSTRACT

Reel slitting device for a web that includes a web supply section, a longitudinal slitting section, and a reeling section, and method for packaging partial rolls in the reeling section of the roll slitting device. The device includes at least one propelling device for reeling at least one partial roll and a packaging device that packages at least a periphery of the at least one partial roll. The the packaging device utilizes the at least one propelling device. The method includes slitting a web sheet into a plurality of partial webs, reeling the partial webs, in the reeling section, into a plurality of partial rolls, attaching a packaging web to a peripheral portion of at least one of the plurality of partial rolls in the reeling section, and rotating the at least one of the plurality of partial rolls to wind the packaging web around a radial surface of the at least one of the plurality of partial rolls.

30 Claims, 4 Drawing Sheets

REEL SLITTING DEVICE AND METHOD

CROSS-REFERENCE TO RELATED APPLICATIONS

The present application claims priority under 35 U.S.C. § 119 of German Patent Application No. 197 17 249.0, filed on Apr. 24, 1997.

BACKGROUND OF THE INVENTION

1. Field of the Invention

The present invention relates to a reel slitting device for a web, e.g., a paper web. The reel slitting device includes a web supply section, a longitudinal slitting section, and a reeling section. The reeling section includes at least one propelling device for reeling at least one partial roll. A reel slitting device similar in general to that discussed above is sold under the name DuoRoller II by Voith Sulzer Papiermaschinen GmbH, in Heidenheim, Germany.

2. Discussion of Background Information

Paper webs are generally finished in a paper machine with a width greater than a width that can be manipulated in printing houses or other factories for secondary processing. That is, finished paper webs may have a width at the flank of the paper machine in the order of, e.g., 10.0 m, while printing houses generally process narrower widths, e.g., 0.8 m to 3.8 m. For this reason, the paper web is generally sectioned into several longitudinal strips by a longitudinal slitting section and then wound in a winding section into partial rolls. The paper web can be, e.g., unwound from a roll or guided directly from another processing station such as a calender.

The manufacture of partial rolls is generally one of the last work steps performed prior to completing the paper roll, i.e., to forward to consumers or factories for secondary processing. After the manufacture of the partial rolls, packaging of the rolls generally occurs. The packaging serves, e.g., to protect the roll from damage.

The packaging generally occurs via a packaging web wrapped around a periphery of the partial roll, so that the packaging web can be applied in one or more layers. The packaging web also generally projects axially over the front ends of the rolls. The axial projections of the packaging may then be folded in and these front ends can be closed with so-called front end caps. For this process, the supply of partial rolls to packaging machines is known. However, these packaging machines or packaging facilities require considerable construction space, which increases the costs in the construction and maintenance of a paper factory. Moreover, the packaging machine requires increased manpower, e.g., operations personnel.

German Patent Application No. PS 251 396 describes a device for packaging material rolls that includes a first winding bed having two support rolls propelled by a common drive belt for winding up a material roll. The downstream support roll of the two support rolls, in the run direction, is coupled with a subsequent support roll to form another winding bed that has its own propelling device. On the other winding bed, the finished, wound web rolls can be packaged.

German Patent Application No. OS 2 002 725 describes a process and a device for transverse slitting, winding, and securing of longer web segments of paper or foil material. The web is wound in a winding station in which several rolls are arranged so that they surround the winding roll, which has yet to be wound, in peripheral direction at different positions. This winding station is connected to a packaging station via a transport path that consists of two belt groups guided parallel to each other. The winding station is arranged so that it can hold the wound web roll during reeling so that it does not come into contact with the belts of the conveyer belt groups. The conveyer belt groups are guided at a rate of speed so that the complete, wound web roll is transported to the packaging station with decreasing speed, but is no longer capable of winding.

SUMMARY OF THE INVENTION

The present invention enables the winding and packaging of partial rolls while holding costs low. In this regard, the reel slitting device generally discussed above provides a packaging device located within the reeling (winding) section. This packaging device packages at least a periphery of a partial roll and utilizes the propelling device in the packaging of the partial roll.

Several advantages are simultaneously obtained through the present invention. For example, construction space can be significantly reduced because the packaging device is at least partially integrated into the winding section. At least the peripheral packaging can be produced in the winding section. In this regard, the present invention at least partially protects the partial roll starting in the winding station. That is, because most conveyer devices engage the periphery of the roll, if a peripheral packaging is already present at the winding station, then, at the most, the peripheral packaging, and not the paper web itself, may be damaged. The front ends may be packaged later in an arrangement of this type. That is, instead of exclusively using a known mechanism for the winding of the partial rolls, the present invention rotates the partial roll during the manufacturing of the peripheral packaging. Because no additional mechanism is necessary to provide this rotation, costs and processing time are reduced. The times necessary for the entire production process are usually composed of actual processing times and the times that are necessary for introducing or removing the corresponding rolls or partial rolls into the individual processing stations. However, in accordance with the features of the present invention, because the transfer between the winding station and the packaging station is reduced, the corresponding transfer times are correspondingly reduced, resulting in shorter times for treating the paper rolls. Moreover, the personnel for operating the packaging machine can also be reduced.

In a particular embodiment, the packaging device includes at least one packaging web dispenser that may be moved parallel to a winding axis. With the packaging web dispenser, individual partial rolls may be successively packaged, i.e., one after the other. This is particularly advantageous if partial rolls having alternating (or varying) widths are being processed. The partial rolls then can be located at different axial positions without requiring consideration of whether the packaging web is available. Instead, the packaging web is made available where the partial roll is produced.

In a particular benefit of the present invention, the packaging web dispenser may be moved into a position outside the partial roll. Because the partial rolls are generally ejected from the winding station laterally, i.e., transverse to the winding axis, the present invention utilizes a packaging web dispenser that may be moved, e.g., in an axial direction, and that is located beyond the web width. Because of the location of packaging web dispenser, the possibility for lateral ejection remains.

It may be particularly advantageous if the packaging web dispenser can be swivelled opposite the winding axis and can be moved parallel to the winding axis in the manufacture of the peripheral packaging. A peripheral packaging which is applied around individual partial rolls along a helical line may be produced. This method may be of significant advantage, particularly when utilized in conjunction with a reel slitter. In a reel slitter of this type, web rolls having different (various) widths may be produced. If it was necessary to produce a corresponding packaging web for each of the different web widths produced, considerable difficulties would arise in storing such packaging webs in reserve. However, if the packaging web dispenser creates or provides helical packaging, then it is not necessary to have several packaging webs that correspond to the various widths of the partial rolls. In this manner, a single packaging web having a fixed width, which may be relatively narrow with respect to the partial roll width, e.g., between approximately 30 and 80 cm, can be used for packaging substantially all partial rolls. The necessary axial length of the peripheral packaging then results automatically in the manufacture of the peripheral packaging. That is, if an axially longer partial roll is packaged, then correspondingly more revolutions of of the partial roll are necessary to produce the peripheral packaging.

If a parent roll or a Web that is guided from a preceding processing device is separated into several partial rolls, it may be advantageous if the individual partial rolls are not immediately wound in-line at the same time, but rather separate from each other. Thus, it is known to provide two (or more) positions in which the winding axes do not correspond. Thus, in the present invention, the winding section may advantageously include two winding position groups. In this manner, the winding axes of the winding positions of each winding position group are substantially coaxial, and the winding axes of the winding position groups are staggered, i.e., alternatingly positioned in the winding position groups in the axial direction, between the winding position groups from one end of the original (unslit) web to the other end, and gaps are formed between adjacent partial rolls in both of the winding position groups. In this way, a packaging web dispenser may be provided for each winding position group. Thus, if individual packaging web dispensers are provided for each winding position group, then the packaging procedure can be accelerated, i.e., virtually reducing the packaging time in half.

The partial rolls are advantageously propelled to both winding position groups via a same central roll at the periphery. In this manner, all of the partial rolls have a same peripheral speed that corresponds to the velocity of discharge on the parent roll. Thus, good reeling ratios result in an easy manner, without the need for an individual mechanism for each winding position group.

The packaging web dispenser may preferably include an adhesive mediation application) device and a guiding device that guides the side of packaging web made adhesive to the partial roll. In this way, the packaging web adheres to a periphery of the partial roll to be packaged. If the partial roll is then rotated, the partial roll will pull the packaging web automatically and simultaneously wind the packing web onto itself. Further, glue may be deposited as the packaging web is paid out to the partial roll. However, in many cases, it is sufficient if the glue is deposited anew at the end of the packaging process. Still further, other possibilities for the adhesion process may be selected, e.g., a packaging web already coated with a dissolvable glue that need only to be moistened, or packaging webs coated with a hot melting bonding agent that need only be heated.

The guide device may advantageously provide a guide path that ends at a periphery of a partial roll in front of an arrangement of the partial roll on a roll. The packaging web may then be guided via the guide path to the periphery of the partial roll, and, in particular, to a position where the packaging web goes into an opening between the reel and roll. In this position, the packaging web may be pressed against the periphery of the partial roll to obtain satisfactory adhesion, so that the packaging web sticks to the periphery of the partial roll, at least at the beginning of the packaging process.

It may preferred that the guide path have a guide face, in which a distance of its end from the roll is adjustable. At a beginning of the packaging process, it may be frequently necessary to bring the packaging web as close to the periphery of the partial roll as possible. During the course of the packaging process, however, the guide face may be an impediment, e.g., when the packaging web dispenser is moved parallel to the axis during the production of the peripheral packaging. Thus, if the end of the guide face may be pulled back, to increase the distance between the guide face and the partial roll or the roll, the packaging process will no longer hindered by the guide face.

It may be advantageous to locate the winding station in a region of a machine frame so that the packaging device is hung on the machine frame. The machine frame may be available at many reel-slitting/winding stations to facilitate positioning of the packaging device.

It may be preferred that the vertical position of the packaging device be adjustable so that the packaging device may be lifted, e.g., when the packaged partial rolls are ejected. By raising or lowering the packaging device, and, in particular, the packaging web dispenser, a favorable supply of the packaging web to the partial rolls may be ensured. This may be particularly advantageous when considering the tension of the packaging web.

During winding and packaging, the partial roll may be positioned to lie between two rolls. One of the rolls may be, e.g., a propelling roll, and the other roll may merely serves as a support roll. With an arrangement of this kind, the packaging web may be guided between the reel (partial roll) to be packaged and one of the two rolls with low expenditure, so that the peripheral packaging can be produced right after the reeling process.

In an alternative embodiment, the partial roll can lie on a roll, whereby a roll core holding device may be located above the roll. At a beginning of the winding process, the roll core holding device may be pushed many times in the direction of the roll, so that the roll can develop a surface drive. As the roll diameter increases, so does the weight of the partial roll. In this manner, the roll core holding device only assumes holding functions. With an embodiment of this kind, peripheral packaging can be produced easily, since one guides the packaging web into the opening between the reel and roll.

In another advantageous embodiment, a spreading device may be located in front of the reeling device, and numerous partial rolls may be located at a distance to one another in the winding device. A knife attachment may be provided to move between the partial rolls. In this embodiment, the web may be spread after slitting, i.e., the individual webs may be guided to a predetermined distance, e.g., several centimeters, from one another in the winding device. In particular, when a packaging web dispenser is used, which may be laterally displaceable and adjustable by angle, a helical peripheral packaging of all of the partial rolls may be produced after completion of the partial rolls. This is possible because all of the partial rolls generally have a same diameter. After producing the peripheral packaging, a separation, e.g., via the knife attachment, may be undertaken between the individual, packaged partial rolls, so that the partial rolls can again be manipulated individually.

It may be preferred that the knife attachment be located parallel to the winding axis so that varying widths of the partial rolls can be manipulated. The knife attachment may be movable to a position at which separation is necessary. In this manner, successive separation of the individual partial rolls may be undertaken. The knife attachment, however, need only to contact a point of the periphery because peripheral slitting occurs due to the rotation of the reel.

Accordingly, the present invention is directed to a reel slitting device for a web that includes a web supply section, a longitudinal slitting section, and a reeling section that includes at least one propelling device for reeling at least one partial roll and a packaging device that packages at least a periphery of the at least one partial roll. The the packaging device utilizes the at least one propelling device.

In accordance with another feature of the present invention, the packaging device may include at least one packaging web dispenser adapted to be moved parallel to a reeling axis. Further, the packaging web dispenser may be adapted to be shifted to a position axially outside the at least one partial roll. Further, the packaging web dispenser may be adapted to be positioned at an angle oblique to the reeling axis and adapted to be moved parallel to the reeling axis during peripheral packaging of the at least one roll.

In accordance with another feature of the present invention, the reeling section may include two reeling position groups. Each reeling position group may include at least one reeling position, and each reeling position may have a reeling position axis. Each reeling position axis in each reeling position group may be coaxially aligned, and the reeling position axes of both reeling position groups may be staggered from one edge of the web to the other edge. The partial rolls in one of the reeling position groups are positioned with a radial gap to the partial rolls in the other reeling position group, and a packaging web dispenser is associated with each reeling position group. Further, the partial rolls in both reeling position groups may have peripheral surfaces driven by a same central roll.

In accordance with still another feature of the present invention, the packaging web dispenser may include an adhesive application device and a guide device. The adhesive application device may be adapted to make a side of the packaging web adhesive and the guide device may be adapted to supply the adhesive side of the packaging web to a peripheral surface of the at least one partial roll. Further, the guide device may include a guide path extending to the periphery of the at least one partial roll and in front of a nip formed between the at least one partial roll and one of a central roll and a winding roll. Still further, the guide path may be positionably adjustable to change a distance between an end of the guide path and the one of the central roll and the winding roll.

In accordance with a further feature of the present invention, the device may include a machine frame and the reeling section may be located near the machine frame and the packaging device may be coupled to the machine frame. Further, the packaging device may be coupled to the machine frame to be adjustably vertical positionable.

In accordance with another feature of the present invention, the at least partial roll may be positioned on two rolls during reeling and packaging.

In accordance with a still further feature of the present invention, the device may include a roll and a roll core holding device. The at least one partial roll may be positioned on the roll and the roll core holding device may be positioned above the roll.

In accordance with still another feature of the present invention, the at least one partial roll may include a plurality of partial rolls, and the device may further include a spreading device positioned in front of the reeling section to axially space the plurality of partial rolls and a knife attachment adapted to be guided between the axially spaced partial rolls. Further, the knife attachment may be adapted to be moved parallel to the reeling axis.

The present invention is directed to a method of producing peripherally packaged partial rolls in a reeling section of a web reeling device. The method includes slitting a web sheet into a plurality of partial webs, reeling the partial webs, in the reeling section, into a plurality of partial rolls, attaching a packaging web to a peripheral portion of at least one of the plurality of partial rolls in the reeling section, and rotating the at least one of the plurality of partial rolls to wind the packaging web around a radial surface of the at least one of the plurality of partial rolls.

In accordance with another feature of the present invention, the reeling of the partial web may include, with respect to a direction transverse to a web transport direction, alternatingly positioning the partial rolls in one of two reeling position groups such that an axial gap between partial rolls in a same reeling position group corresponds with a position of a partial roll in the other reeling position group, and maintaining a radial gap between the two reeling position groups. Further, the reeling of the partial web may further include positioning at least a portion of a peripheral surface of each partial roll in contact with a drivable central roll. Still further, the attaching of the packaging web may include forming an adhesive surface on the packaging web, guiding the packaging web between the at least one partial roll and the drivable central roll, and pressing the adhesive surface against the at least one partial roll via a force of the at least one partial roll against the drivable central roll.

In accordance with another feature of the present invention, the method may include forming the two reeling position groups with a central roll and two winding rolls positioned on opposite sides of the central roll. Further, the attaching of the packaging web may include forming an adhesive surface on the packaging web, guiding the packaging web between the at least one partial roll and a respective one of the two winding rolls, and pressing the adhesive surface against the at least one partial roll via a force of the at least one partial roll against the respective one of the two winding rolls.

In accordance with still another feature of the present invention, the reeling of the partial web may include coaxially aligning a reeling axis of each of the plurality of partial rolls, and maintaining an axial space between each of the plurality of partial rolls. Further, the coaxial aligning may include positioning the partial rolls on a parallelly arranged drivable central roll and winding roll. Still further, the attaching of the packaging web may include forming an adhesive surface on the packaging web, guiding the packaging web between the at least one partial roll and the winding roll, and pressing the adhesive surface against the at least one partial roll via a force of the at least one partial roll against the winding roll. Further still, the method may include packaging each of the partial rolls in a single package and slitting the single package at the axial spaces.

In accordance with a further feature of the present invention, the method may include packaging each of the partial rolls in a single package and slitting the single package at the axial spaces.

In accordance with a still further feature of the present invention, the method may include axially moving a packaging web device beyond an axial extent of the at least one partial roll and laterally ejecting the at least one partial roll.

In accordance with yet another feature of the present invention, the method may include moving a packaging web device radially above the at least one partial roll and laterally ejecting the at least one partial roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
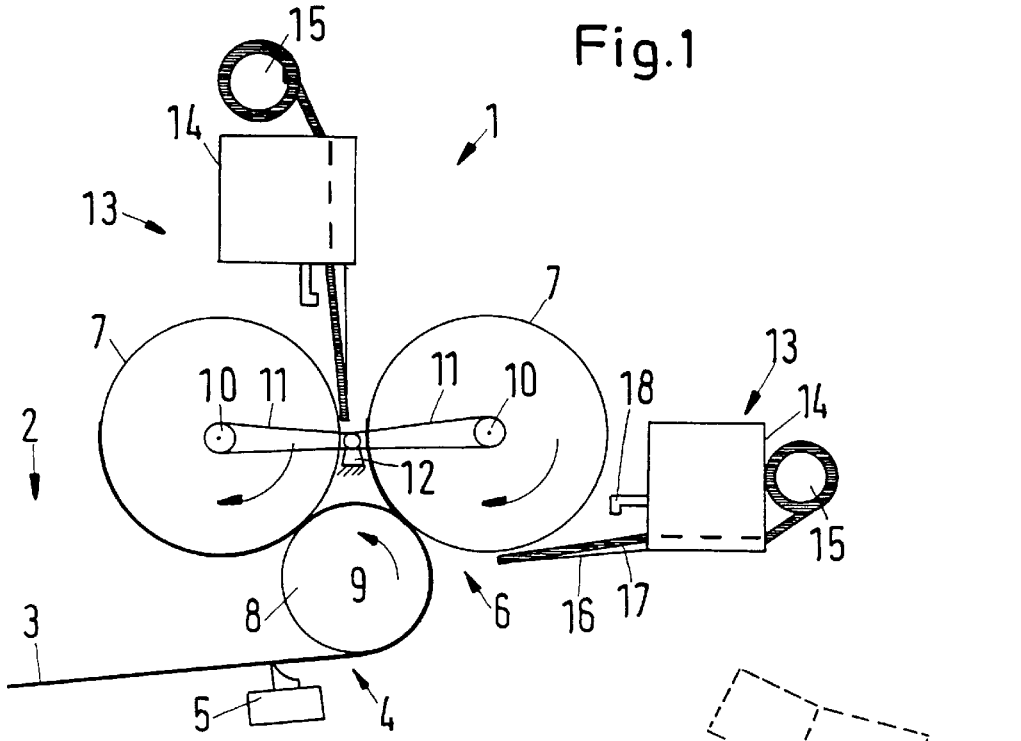
FIG. 1 illustrates a schematic view of a first embodiment of a reel slitting device in accordance with the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A reel slitting device 1 may include a supply section 2 that supplies, e.g., via winding off a jumbo roll or a parent roll, or guiding directly from a calender or another secondary processing device, a web 3. This delivery of the web is generally known and, therefore, will not be discussed further.

Web 3 may pass through a longitudinal slitting section 4 in which a slitting device 5 may be located. Slitting device 5 may section web 3 into numerous web sections lying adjacent to each another in a direction transverse to a web transport direction. The width of the web sections, generally referred to as "partial webs", may adjusted to the needs of a consumer of the finished partial web. For example, if web 3 has a width, e.g., between approximately 6 and 10 m, then the partial webs may have a width of, e.g., between approximately 0.8 and 3.8 m. Further, slitting devices 5 may be adjustably positionable in the direction transverse to the web travel direction, so that different slit patterns may be created, i.e., so that web 3 may be sectioned into numerous partial webs having various (different) widths.

Each individual partial web may be guided into a reeling (winding) section 6 to be wound up and form "partial rolls" 7. As is more clearly illustrated in FIG. 2, partial rolls 7 may have various or different widths that correspond with the widths of slitting device 5.

A central roll 8 may be located in reeling section 6 and driven to rotate in a direction indicated by arrow 9. A peripheral portion of central roll 8 may be wrapped by web 3, or more particularly, by the partial webs over a particular angular range. Partial rolls 7 may be positioned to lie in juxtaposition, i.e., adjacent to each other, on central roll 8. Roll cores 10 may be carried on levers 11 that are rotatably mounted on a stationary base 12. Stationary base 12 may be fixed, e.g., in a machine frame (not depicted).

When central roll 8 rotates, partial rolls 7 are driven or propelled at their peripheries by contact with central roll 8 to wind up the partial webs of the web 3 to form partial webs 7.

Figure 2:
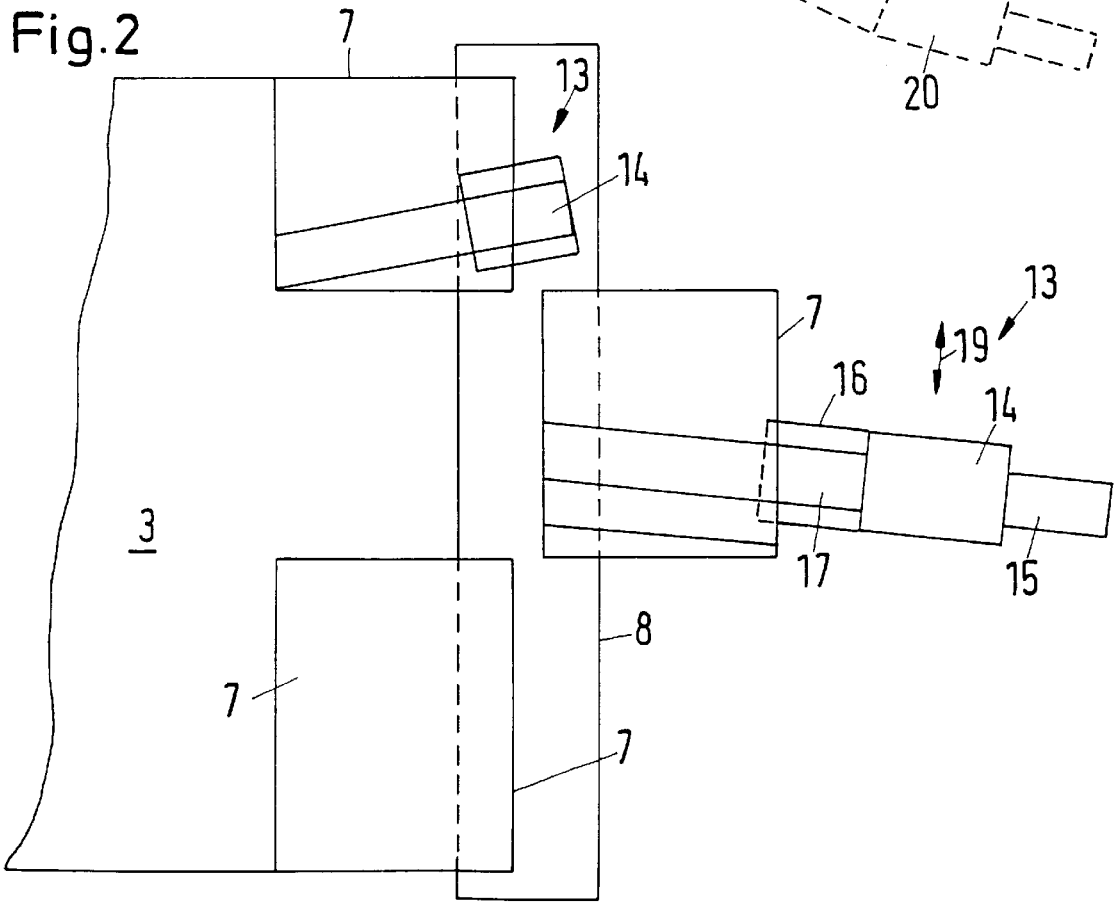
FIG. 2 illustrates a schematic top view of the embodiment depicted in FIG. 1.

As seen in FIG. 2, partial web rolls 7 may be separated or divided into the two winding positions on central roll 8. In the exemplary illustration of FIG. 2, two partial web rolls 7 may be positioned on a left-hand portion of central roll 8 and one partial web roll 7 may be positioned on a right-hand portion of central roll 8. The left-hand position and the right-hand position of partial rolls 7 form the winding position groups along central roll 8. Thus, in accordance with the exemplary embodiment of FIG. 2, the left-hand winding position group includes two partial rolls 7 and the right-hand winding position group includes one partial roll 7. Partial rolls 7 may be positioned opposite each other with a gap, so that they will not affect one another during reeling. The winding axes of each partial roll 7 in a particular winding position group are to be aligned. The design of each partial roll 7 is substantially similar to each other partial roll 7.

Further, a packaging device 13 may be located within reeling section 6. Packaging device 13 may include a packaging web dispenser 14 associated with each winding position group, and each packaging web dispenser 14 may include a packaging roll 15. The width of packaging web roll 15 may be substantially smaller than a width of any of the partial rolls 7, e.g., between approximately 0.3 and 0.8 m.

Each packaging web dispenser 14 also includes a guide face 16, on which the packaging web 17 unwound from packaging web roll 15 can be pushed forward up to a periphery of partial roll 7. Further, an adhesive deposition device 18 may be provided to apply glue onto the side of packaging web 17 turned toward partial roll 7. Guide face 16 may be pushed forward toward partial roll 7, so that a gap between guide face 16 and a surface of partial roll 7 can be maintained at as small as possible, and may also be drawn back so that the packaging process will not be disrupted.

As seen in FIG. 2, an angle of packaging web dispenser 14 with respect to perpendicular to the axis of partial roll 7 can be adjusted so that, the dispensed packaging web 17 is wound around partial roll 7 in a helical path.

As partial roll 7 rotates, packaging web dispenser 14 moves in a direction of double arrow 19, i.e., axially with respect to partial roll 7. During winding partial rolls 7 turn, of course, in one direction only. The direction of movement of the packaging web dispenser 14 is determined by the angle of the dispensed web packaging to perpendicular to the partial roll axis.

When partial roll 7 rotates a helical peripheral packaging is formed such that adjacent strips of packaging web 17 are arranged to overlap to produce a multi-layered peripheral packaging. In this manner, arbitrarily long partial rolls 7 may be packaged with a single packaging web width, i.e., it is not necessary to store various widths of packaging web to correspond with each possible partial roll width. Thus, the present arrangement provides significant flexibility. In other words, the width of partial rolls may be arbitrarily changed in accordance with a particular demand without requiring a corresponding change in the packaging web supply. Thus, once a partial roll 7 is complete, packaging web dispenser 14 may be moved relative to partial roll 7 to package the same.

Individual partial rolls 7, in each winding position group, may be provided one after the other with peripheral packaging. However, it is also possible to provide several packaging web dispensers 14 for each winding position group. In this manner, the packaging process may be accelerated.

As illustrated in FIG. 2, e.g., packaging web dispenser 14 may be axially moved to a position 20 (depicted in dashed lines) that is outside the width of web 3. When packaging web dispenser 14 is moved into this position, partial rolls 7 may be laterally discharged without hindrance from packaging web dispenser 14. Thus, when partial rolls 7 leave reel slitting device 1, then they are already provided with packaging at least around their periphery. In this manner, partial rolls 7 may be protected to a great extent from mechanical damage, and because the packaging directly follows the completion of the partial rolls, a substantial amount of time may be saved. Further, because the packaging device is integrated into the reeling device, construction space is also conserved.

Figure 3:
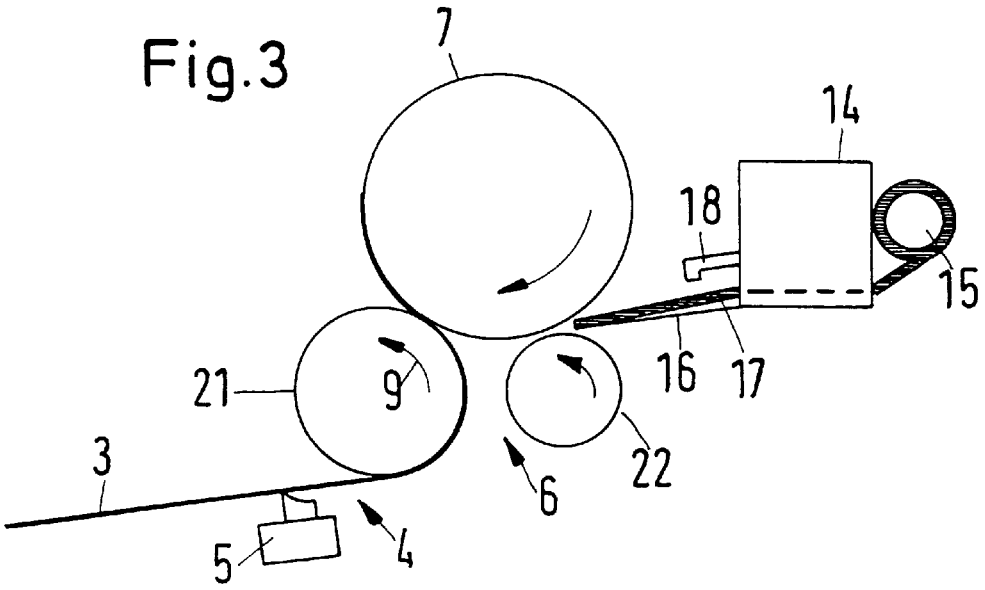
FIG. 3 illustrates a schematic view of a second embodiment of a reel slitting device in accordance with the present invention.
Figure 4:
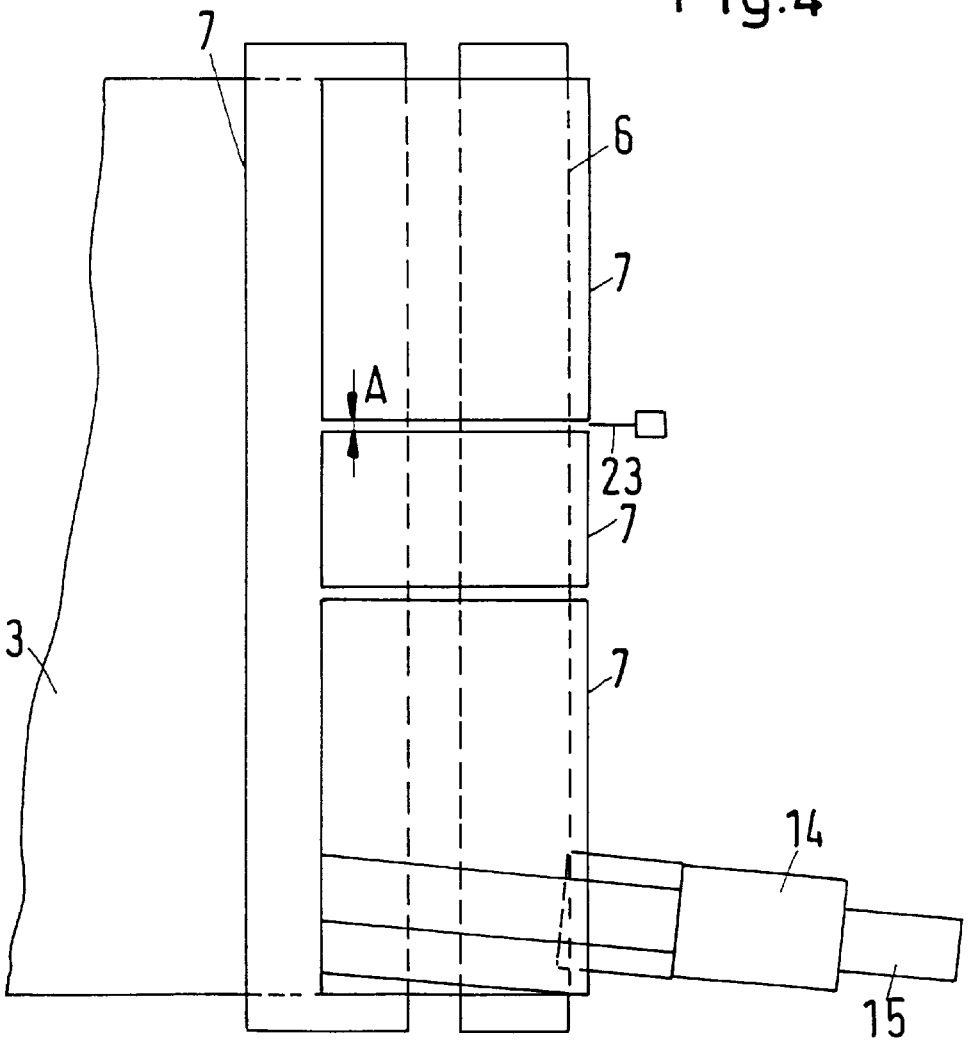
FIG. 4 illustrates a schematic top view of the embodiment depicted in FIG. 3.

FIGS. 3 and 4 illustrate another embodiment of a reel slitting device, in which corresponding parts are given corresponding reference numbers. In contrast to the embodiment depicted in FIGS. 1 and 2, in this exemplary embodiment, all partial rolls 7 are commonly aligned and wound lying adjacent each other side by side. Spreading rolls (not depicted in detail) may be utilized to provide web guidance and a small distance A between adjacent partial rolls 7.

Partial rolls 7 may be supported on two rolls 21 and 22, in which roll 21 may be driven or propelled in a direction of arrow 9. Packaging web 17 may be guided into the region between roll 22 and partial roll 7. In this region, packaging web 17 may be adhered to a peripheral surface of partial roll 7, if an adhesive, e.g., glue, is deposited on packaging web 17, e.g., via glue deposition device 18.

With this embodiment, partial rolls 17 lying adjacent to each other (i.e., side by side) may be packaged in a single packaging process, i.e., packaging web dispenser 14 may move across the entire width of web 3 to package all of the partial rolls 7 together, including gaps. Thus, a coherent packaging is provided, which may be separated into individual partial roll sections with a knife 23. Knife 23 may be positioned to move parallel to the winding axis and transverse to the winding axis to cut the packaging web 17 to section the coherent packaging into individual partial rolls.

Figure 5:
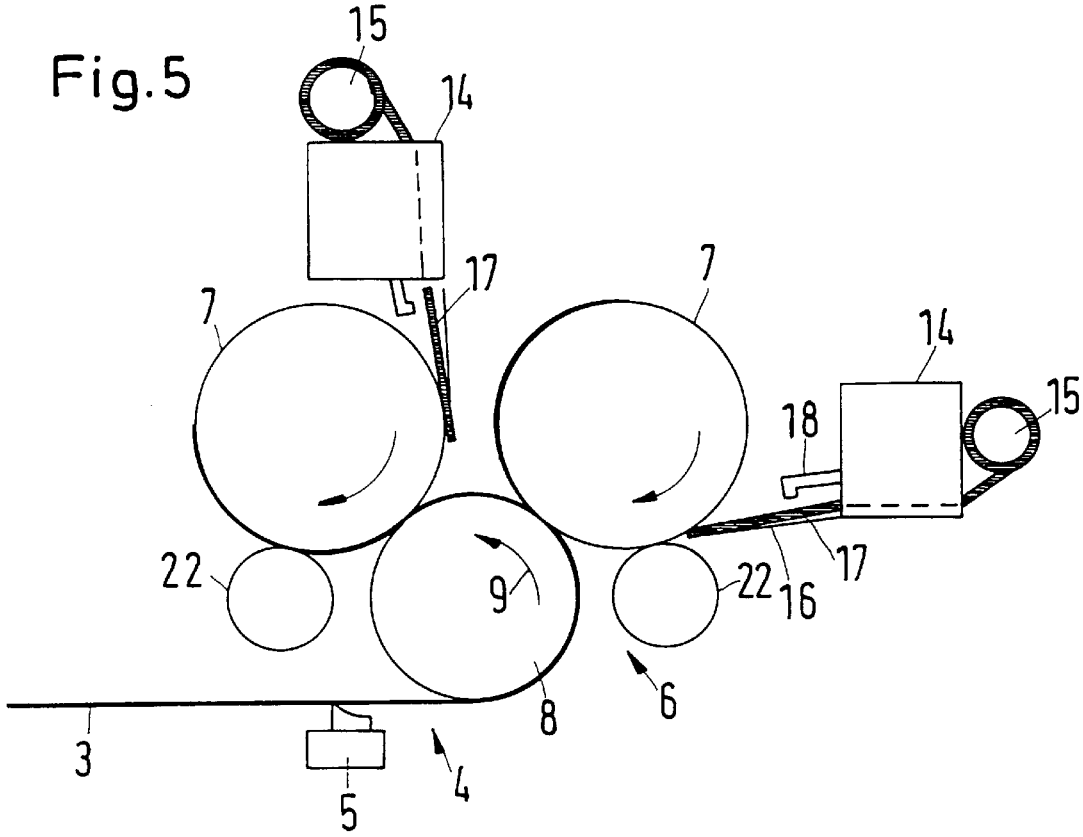
FIG. 5 illustrates a schematic view of a second embodiment of a reel slitting device in accordance with the present invention.
Figure 6:
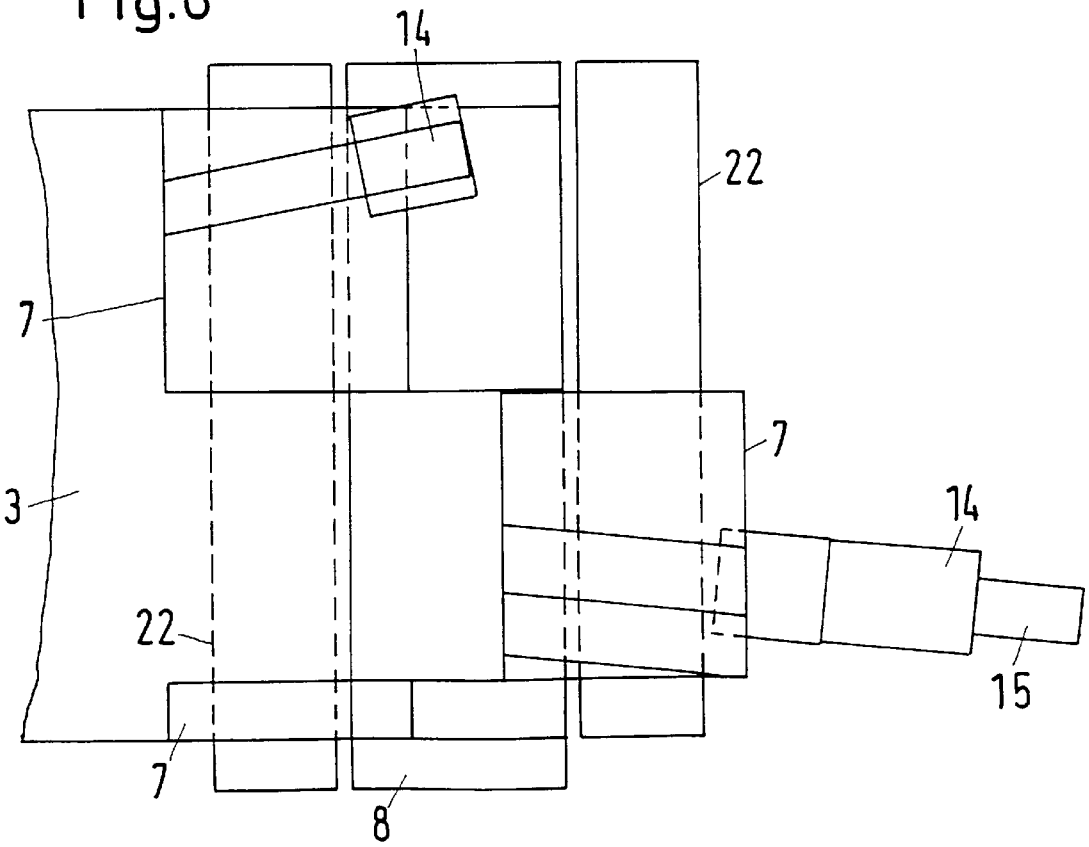
FIG. 6 illustrates a schematic top view of the embodiment depicted in FIG. 3.

FIGS. 5 and 6 illustrate a third embodiment of the reel slitting device of the present invention in which corresponding parts are given corresponding reference numbers. In this exemplary embodiment, two varying winding position groups are shown to be located on both sides of a central roll 8. Partial rolls 7 are positioned to contact central roll 8 and a respective winding (or king) roll 22.

Figure 7:
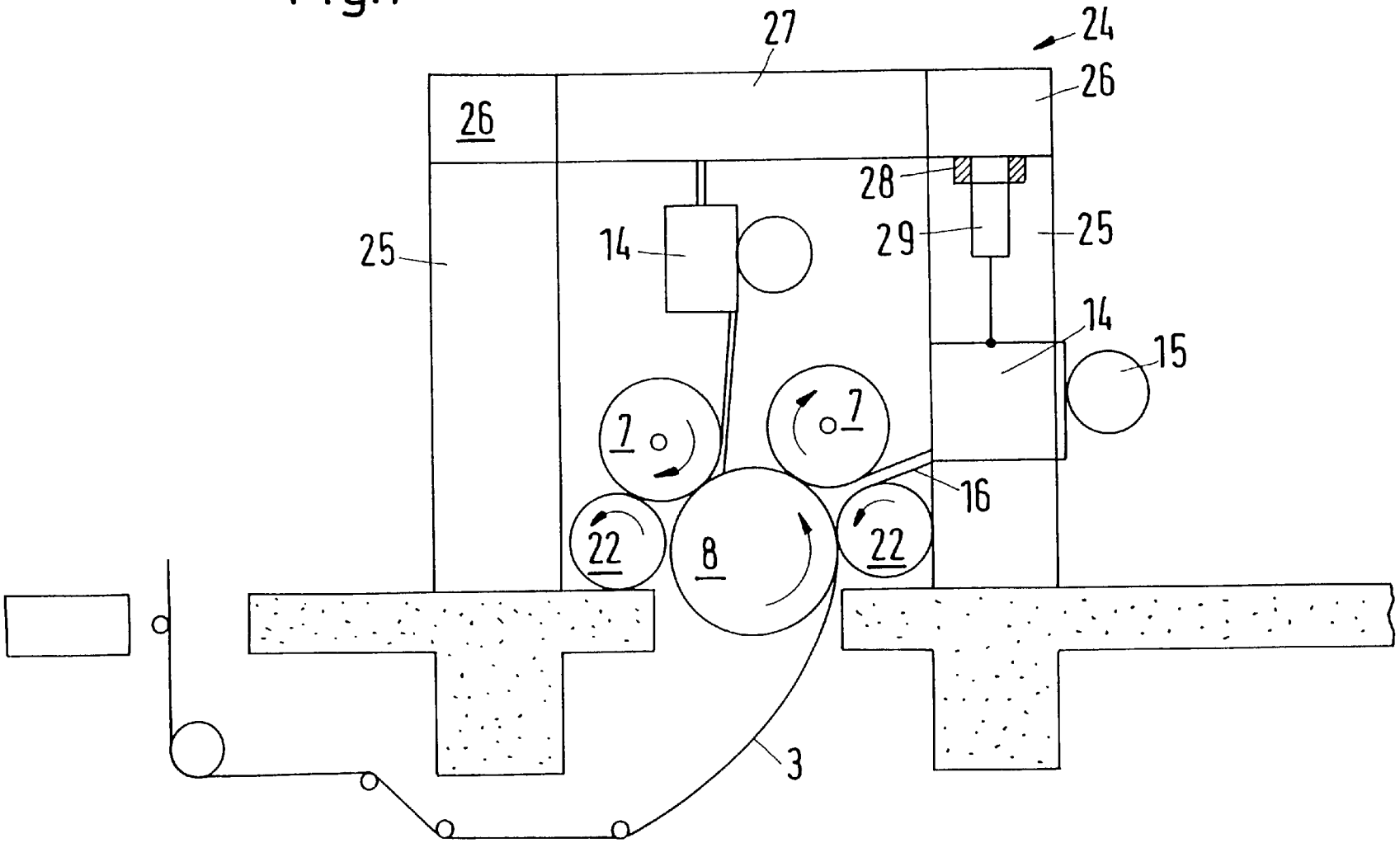
FIG. 7 illustrates the second embodiment depicted in FIG. 5 with a machine frame.

FIG. 7 schematically illustrates the exemplary embodiment of FIG. 5 within an exemplary environment. For example, the reel slitting device of the present invention may be disposed within a machine frame 24. Machine frame 24 may include four supports 25, a longitudinal girder 27 extending in a direction of web transport for each of the two front ends, and a transverse girder 26 extending transverse to the web transport direction.

In FIG. 7, a slide 28 may be moved laterally across the rolls on transverse girder 26 and may be coupled to packaging web dispenser 14 for at least the right-hand side partial roll 7. The coupling between packaging web dispenser 14 and slide 28 may be provided via a piston-cylinder-unit 29 so as to enable packaging web dispenser 14 to be lifted above partial roll 7, thus, enabling partial roll 7 to be discharged without colliding with packaging web dispenser 14. For this, guide face 16 must be retracted or drawn back to the extent that an upward movement past partial roll 7 is possible.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A reel slitting device for a web comprising:

a web supply section;

a longitudinal slitting device;

a reeling section that includes at least one propelling device for reeling at least one partial roll around a reeling axis and a packaging device that packages at least a periphery of the at least one partial roll, wherein the packaging device utilizes the at least one propelling device; and the packaging device comprising at least one packaging web dispenser adapted to be moved parallel to the reeling axis.

2. The device in accordance with claim 1, the packaging web dispenser adapted to be shifted to a position axially outside the at least one partial roll.

3. The device in accordance with claim 1, the packaging web dispenser adapted to be positioned at an angle oblique to the reeling axis and adapted to be moved parallel to the reeling axis during peripheral packaging of the at least one roll.

4. A reel slitting device for a web comprising:

a web supply section;

a longitudinal slitting device for slitting the web into a plurality of partial webs;

a reeling section comprising at least one propelling device, and further comprising:

two reeling position groups, wherein at least one partial roll is adapted to be wound in each reeling position group;

each reeling position group includes at least one reeling position in which the at least one partial roll is wound, and each reeling position includes a reeling position axis around which the at least one partial roll is wound;

the reeling position axes of a same reeling position group are coaxially aligned and the reeling position axes of both reeling position groups are staggered from one edge of the web to the other edge;

the partial rolls of the same reeling position group are positioned to be spaced apart with a radial gap that corresponds to the position of the partial rolls in the other reeling position group; and a packaging device that packages at least a periphery of the at least one partial roll and comprises a packaging web dispenser which is associated with each reeling position group, wherein the packaging device utilizes the at least one propelling device.

5. The device in accordance with claim 4, the partial rolls in both reeling position groups having peripheral surfaces driven by a same central roll.

6. The device in accordance with claim 1, the packaging web dispenser comprising an adhesive application device and a guide device;

the adhesive application device adapted to make a side of the packaging web adhesive; and the guide device adapted to supply the adhesive side of the packaging web to a peripheral surface of the at least one partial roll.

7. The device in accordance with claim 6, the guide device comprising a guide path extending to the periphery of the at least one partial roll and in front of a nip formed between the at least one partial roll and one of a central roll and a winding roll.

8. The device in accordance with claim 7, the guide path being positionably adjustable to change a distance between an end of the guide path and the one of the central roll and the winding roll.

9. The device in accordance with claim 1, further comprising a machine frame, the reeling section being located near the machine frame and the packaging device being coupled to the machine frame.

10. The device in accordance with claim 9, the packaging device being coupled to the machine frame to be adjustably vertical positionable.

11. The device in accordance with claim 1, the at least partial one roll is positioned on two rolls during reeling and packaging.

12. The device in accordance with claim 1, further comprising a roll and a roll core holding device;

the at least one partial roll being positioned on the roll; and the roll core holding device being positioned above the roll.

13. The device in accordance with claim 1, the at least one partial roll comprising a plurality of partial rolls;

the device further comprising a spreading device positioned in front of the reeling section to axially space the plurality of partial rolls; and a knife attachment adapted to be guided between the axially spaced partial rolls.

14. The device in accordance with claim 13, the knife attachment adapted to be moved parallel to the reeling axis.

15. A method of producing peripherally packaged partial rolls in a reeling section of a web reeling device comprising:

slitting a web sheet into a plurality of partial webs;

reeling the partial webs, in the reeling section, into a plurality of partial rolls;

attaching a packaging web to a peripheral portion of at least one of the plurality of partial rolls in the reeling section; and rotating the at least one of the plurality of partial rolls to wind the packaging web around a radial surface of the at least one of the plurality of partial rolls, wherein the reeling of the partial web comprises:

with respect to a direction transverse to a web transport direction, alternatingly positioning the partial rolls in one of two reeling position groups such that an axial gap between partial rolls in a same reeling position group corresponds with a position of a partial roll in the other reeling position group; and maintaining a radial gap between the two reeling position groups.

16. The method in accordance with claim 15, the reeling of the partial web further comprising positioning at least a portion of a peripheral surface of each partial roll in contact with a drivable central roll.

17. The method in accordance with claim 16, the attaching of the packaging web comprising:

forming an adhesive surface on the packaging web;

guiding the packaging web between the at least one partial roll and the drivable central roll; and pressing the adhesive surface against the at least one partial roll via a force of the at least one partial roll against the drivable central roll.

18. The method in accordance with claim 15, forming the two reeling position groups with a central roll and two winding rolls positioned on opposite sides of the central roll.

19. The method in accordance with claim 18, the attaching of the packaging web comprising:

forming an adhesive surface on the packaging web;

guiding the packaging web between the at least one partial roll and a respective one of the two winding rolls; and pressing the adhesive surface against the at least one partial roll via a force of the at least one partial roll against the respective one of the two winding rolls.

20. The method in accordance with claim 15, the reeling of the partial web comprising:

coaxially aligning a reeling axis of each of the plurality of partial rolls; and maintaining an axial space between each of the plurality of partial rolls.

21. The method in accordance with claim 20, the coaxial aligning comprising:

positioning the partial rolls on a parallelly arranged drivable central roll and winding roll.

22. The method in accordance with claim 21, the attaching of the packaging web comprising:

forming an adhesive surface on the packaging web;

guiding the packaging web between the at least one partial roll and the winding roll; and pressing the adhesive surface against the at least one partial roll via a force of the at least one partial roll against the winding roll.

23. The method in accordance with claim 22, further comprising packaging each of the partial rolls in a single package; and slitting the single package at the axial spaces.

24. The method in accordance with claim 20, further comprising packaging each of the partial rolls in a single package; and slitting the single package at the axial spaces.

25. The method in accordance with claim 15, further comprising:

axially moving a packaging web device beyond an axial extent of the at least one partial roll; and laterally ejecting the at least one partial roll.

26. The method in accordance with claim 15, further comprising:

moving a packaging web device radially above the at least one partial roll; and laterally ejecting the at least one partial roll.

27. The device in accordance with claim 1, wherein the at least one partial roll includes a plurality of partial rolls axially arranged next to each other, and wherein the packaging web dispenser is adapted to move to each of the plurality of partial rolls, thereby successively wrapping the plurality of partial rolls.

28. The device in accordance with claim 1, wherein the packaging web dispenser is a helical wrapping dispenser which is moved next to the at least one partial web roll and is adapted to helically wrap the at least one partial web roll.

29. The method in accordance with claim 15, further comprising:

moving a packaging web dispenser parallel to the reeling axes in the same winding position group; and successively wrapping the partial rolls in the same reeling position group.

30. The method in accordance with claim 15, further comprising helically wrapping the plurality of partial web rolls.

* * * * *